United States Patent [19]

Moody et al.

[11] 4,033,661

[45] July 5, 1977

[54] SOLDERLESS CONNECTOR FOR INSULATED WIRES

[75] Inventors: Roy A. Moody, Flossmoor; John J. Bulanda, New Lenox, both of Ill.

[73] Assignee: Panduit Corporation, Tinley Park, Ill.

[22] Filed: Feb. 23, 1976

[21] Appl. No.: 660,072

Related U.S. Application Data

[63] Continuation of Ser. No. 481,566, June 20, 1974, abandoned.

[52] U.S. Cl. ..... 339/98

[51] Int. Cl.² ..... H01R 13/38

[58] Field of Search ..... 339/95, 97–99

[56] References Cited

UNITED STATES PATENTS

| | | | |
|---|---|---|---|
| 3,147,058 | 9/1964 | Zdanis | 339/97 R |
| 3,403,372 | 9/1968 | Stenson, Jr. | 339/97 R |
| 3,656,088 | 4/1972 | Seim | 339/98 |
| 3,793,611 | 2/1974 | Johansson et al. | 339/98 |
| 3,845,236 | 10/1974 | Anderson | 339/98 |
| 3,858,157 | 12/1974 | Bazille, Jr. | 339/99 R |
| 3,920,305 | 11/1975 | Scott | 339/98 |

*Primary Examiner*—Joseph H. McGlynn
*Attorney, Agent, or Firm*—Charles R. Wentzel; Richard B. Wakely

[57] ABSTRACT

A self-stripping connector is disclosed wherein a pair of channels are disposed in a unitary insulating body having a base portion and cover portion hingedly secured together. The walls of the insulating body define an aperture extending transversely of and intersecting each of the channels and provide a guide surface for a contact element positioned in the aperture for making positive electrical connection to a pair of wires disposed in the channels. The contact element has a first surface defining an outer boundary that is in contact with the guide surface at points spaced on the boundary lying in more than a single plane and is configured so as to be substantially supported against tipping by the insulating body prior to, and during, engagement with the wires.

20 Claims, 20 Drawing Figures

SOLDERLESS CONNECTOR FOR INSULATED WIRES

This is a continuation of application Ser. No. 481,566, filed June 20, 1974, now abandoned.

BACKGROUND OF THE INVENTION

This invention relates to connectors, and more particularly, to a self-stripping, i.e. solderless, connector for making positive electrical connection to insulated wires.

In the past, self-stripping connectors have been utilized for quickly and easily connecting the ends of two or more insulated wires or the end of one insulated wire to a continuous or through wire previously wired in a circuit. When it was desired to electrically connect the end of one wire to a continuous wire, the connector was fabricated so as to permit application of a force to a contact element from a direction substantially transverse to the direction of the continuous wire. Such a construction was needed in order to avoid interference between the continuous wire and a pair of pliers utilized to apply the required stripping force to the contact element. The contact element was generally adapted to slide in a slot in the connector housing. A force applied in this manner was applied by a pair of pliers lying substantially parallel to the plane of the contact element. Thus, generally only a point or at best a line contact existed between the contact element and the pliers making it difficult to avoid applying the force in a manner that tended to tip the contact element into a position at an angle to the slot thereby requiring forceful deformation of the connector material defining the edges of the slot. Accordingly, it would be desirable to provide a connector having a contact element adapted to receive a stripping force applied by a pair of pliers without tipping the contact element into a position requiring forceful deformation of the connector material defining the guide surface for the contact element.

Another problem with the prior art devices came as a result of the contact plate barely being positioned in its slot prior to the application of a stripping force. It will be appreciated that in the prior art constructions this was necessary in order to provide a relatively small connector. Accordingly, in the prior art constructions, at the initial point of application of the stripping force, the connector housing provided insufficient support for the contact element to retard tipping. Accordingly, it would be desirable to provide a connector having a contact element substantially supported in the connector housing prior to the application of the stripping force without detracting from the size of the connector.

An additional problem with the prior art devices is that it was difficult, if not impossible, to determine the particular position of the wires in the connector both prior to the application of a stripping force and after having applied the stripping force. Accordingly, it was possible not to have the tap wire fully inserted into the connector such that mechanical and electrical connection was not made between the tap wire and the contact element. It would therefore be desirable to fabricate a connector wherein the position of the insulated wires can be inspected both before and after application of the stripping force to the contact element.

Yet a further problem with the prior art devices came as a result of the contact plate having a pair of wire slots positioned such that insertion of a wire in one slot would deflect the remainder of the plate so as to affect the force applied to a wire positioned in the other slot. Prior art structures utilizing a single slot to engage a pair of wires had a similar disadvantage since the wire first placed in the slot would tend to separate the side walls defining the slot and accordingly the sides of the slot could be deflected sufficiently to provide a poor mechanical and electrical contact with the second wire positioned in the slot. Accordingly, it would be desirable to provide a connector having two wire slots wherein the sides of the slots are affected only by the wire positioned therein.

Accordingly, it is an object of the present invention to provide a new and improved self-stripping connector for insulated wires. Another object of the present invention is to provide a connector wherein the force required to strip and electrically connect the insulated wires may be applied without tipping the contact element and deforming the connector. An additional object of the present invention is to provide a connector providing sufficient insulation between exposed portions of the conductor and the external surface of the connector so as to substantially eliminate the possibility of shorting between adjacent wires or structure. Yet another object of the present invention is to provide a self-stripping connector wherein the contact element and the associated guiding surfaces in the connector are configured so as to maximize ease of mating engagement. A further object of the present invention is to provide a self-stripping connector wherein the contact element is substantially supported in the housing prior to the application of a stripping force thereto without a corresponding increase in the size of the connector. Yet a further object of the present invention is to provide support for at least the tap wire on both sides of the portion of the contact element engaging the wire so as to restrain the wire against deflection and provide a reliable mechanical and electrical connection. Still another object of the present invention is to provide a self-stripping connector wherein the outer boundary of the contact element is disposed adjacent the guiding surface of the connector at points spaced on the boundary lying in more than a single plane thereby providing both stability and support for the contact element during insertion. A still further object of the present invention is to provide a self-stripping connector having means for ensuring proper orientation of various sizes of insulated wires. Yet an additional object of the present invention is to provide a self-stripping connector wherein the orientation of the wires both before and after application of a stripping force to the contact element may be visually determined.

Another object of the present invention is to provide a self-stripping connector wherein the wires to be electrically connected are engaged simultaneously by a contact element thereby providing a balanced load which retards tipping of the contact element. A further object of the present invention is to provide a self-stripping connector wherein the contact element is provided with two slots for receiving a wire in each such that material defining the slots is affected only by the wire which each engages during and after application of the stripping force. An additional object of the present invention is to provide a self-stripping connector wherein the contact element engages each wire only once. Other objects and advantages of the present invention will become apparent as the following description proceeds and the features of novelty characterizing the invention will be pointed out with particularity in the claims annexed to and forming a part of this specification.

Brief Summary of the Invention

Briefly, the present invention relates to a self-stripping connector comprising in the preferred embodiment a unitary insulating body having a base portion and a cover portion hingedly secured together for relative movement. One of the portions is provided with a pair of longitudinal wire receiving channels adapted to receive an insulated wire therein. An aperture extends transversely of and intersects each of the channels. The wall or walls of the insulating body defining the aperture provide a guide surface for a contact element adapted to be positioned in the aperture for making positive electrical connection to a pair of insulated wires disposed in the channels. The contact element has a first surface defining an outer boundary that is disposed adjacent the guiding surface at points spaced on the boundary lying in more than a single plane and is substantially supported in the insulating body prior to the application of a stripping force. The connector is provided with means for securely retaining the base and cover portions against relative separation in the assembled position.

BRIEF DESCRIPTION OF THE DRAWINGS

For a better understanding of the present invention, reference may be had to the accompanying drawings wherein the same reference numerals have been applied to like parts and wherein.

Figure 1:
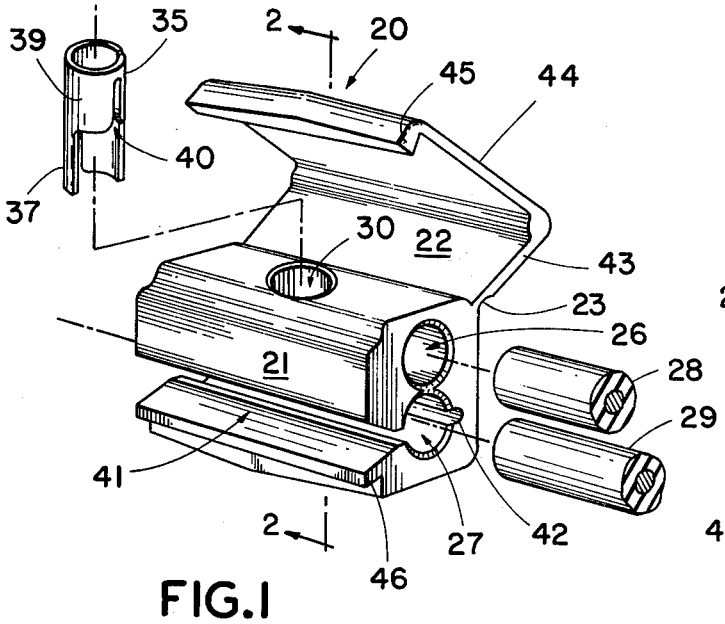
FIG. 1 is an enlarged exploded view of a self-stripping connector built in accord with the preferred embodiment of the present invention.
Figure 2:
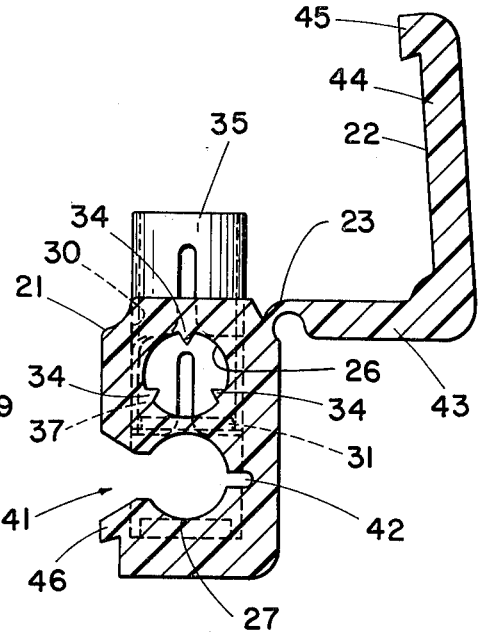
FIG. 2 is an enlarged sectional view of a connector built in accord with the present invention showing the contact element in position prior to the application of a stripping force thereto.
Figure 3:
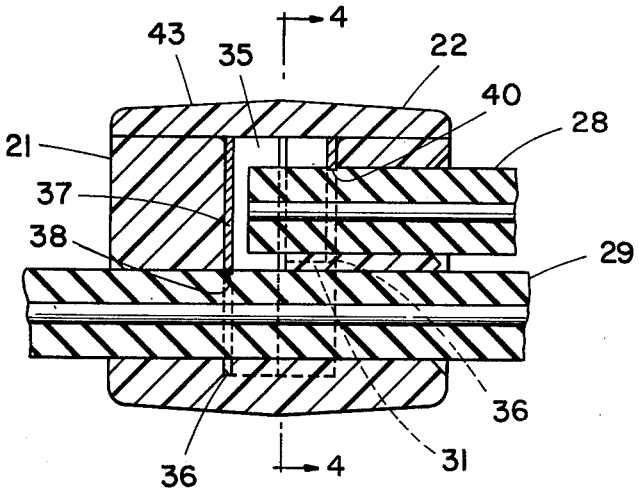
FIG. 3 is a sectional view of an assembled connector built in accord with the present invention.
Figure 5:
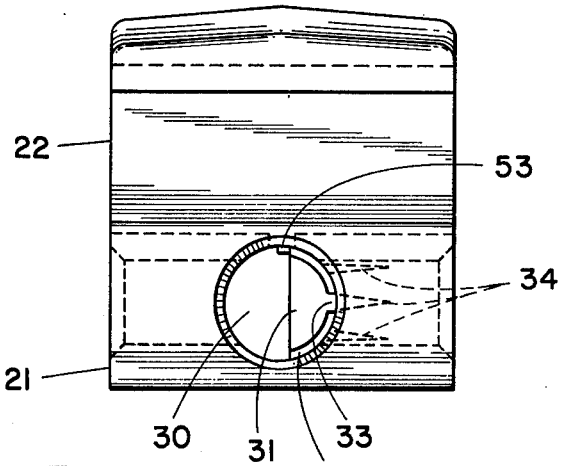
FIG. 5 is a top plan view of the connector of FIG. 1 shown without the contact element and insulated wires.

Referring now to the drawings, there is illustrated a self-stripping connector generally indicated at 20 comprising a unitary body formed from a suitable insulating material, for example, polypropylene, and adaptable for production utilizing injection molding techniques. The unitary body comprises a base portion 21 and a cover portion 22 secured together by a flexible plastic hinge 23. Base portion 21 is provided with a pair of longitudinally extending channels 26 and 27 adapted for receiving a pair of insulated wires 28 and 29. One of the channels 26 extends only partially through the base portion 21. The other channel 27 extends completely through the base portion 21. It will be appreciated that channel 27 could also extend only partially through the base portion 21 if desired. The base portion 21 is provided with an aperture 30 extending transversely of and intersecting each of the channels 26 and 27. As best shown in FIGS. 3 and 5, the aperture 30 is substantially cylindrical in shape extending from the opening in the base portion 21 to the bottom of the channel 26 at which point a ledge 31 extends into the aperture 30 from the wall defining the bottom of the channel 26. The ledge 31 is shown as being substantially flat, however, it will be appreciated that the ledge could be curved to have a contour similar to the channel 26. A groove 32 is disposed in the ledge 31 adjacent the wall defining the aperture 30 and may be continuous or an abutment 33 may extend thereinto substantially in alignment with the axis of the channel 26 for a purpose to be hereinafter described. As best shown in FIG. 2, a plurality of projections 34 extend from the wall of the base portion defining the channel 26 toward the center line of the channel so as to provide an interference fit with the insulation of wires having a diameter smaller than that of the channel 26. These projections additionally serve as insulation grippers for the ordinary sized wires and substantially increase the force required to remove the insulated wire once it has been inserted into the channel 26.

A contact element 35 is positioned in the aperture 30 having its outer boundary being substantially adjacent the wall of the base portion defining the aperture throughout the periphery thereof. By providing a contact element 35 having the partially tubular shape of the present invention in sliding contact with the walls or guiding surface defining the aperture 30, a construction is provided wherein tipping of the contact element 35 is substantially eliminated irrespective of the position of a pair of pliers in applying the stripping force to the contact element 35. Additionally the tubular configuration of the contact element provides for increased column strength thereby eliminating any potential damage to the contact element possible in the prior art construction wherein a flat contact element was positioned in a slot in the housing. It will additionally be appreciated that the open-ended contact element 35 permits visual inspection of the aperture thereby enabling the user to visually determine the particular orientation of the through and tap wires both before and after assembly of the contact element into mechanical and electrical engagement with the through and tap wires.

In order to further enhance the ease of assembly of the connector of the present invention, contact element 35 is coined along its leading edge 36 so as to further eliminate the possibility of the contact element 35 gouging the wall of the base portion 21 defining the aperture 30 during assembly of the contact element into mechanical and electrical engagement with the through and tap wires.

The contact element 35 comprises a first portion or side 37 having a slot 38 therein disposed substantially in alignment with the channel 27 and a second portion or side 39 having a slot 40 therein disposed substantially in alignment with the channel 26. The leading edge 36 of the side 39 is adapted to be positioned in the groove 32 of the ledge 31 thereby permitting the wire to be stripped and positively positioning the second side 39 against movement relative to the base portion 21 after assembly. Thus the walls defining the groove 32 function as a stop to restrain movement of the contact element 35 in the direction of the channels. The abutment 33 may be positioned in the slot 40 to provide support for the wire 28 and additionally eliminate the possibility of any rotational movement of the contact element 35 once the contact element is assembled in electrical engagement with the wires 28 and 29. The ledge 31 provides structurual support for the tap wire 28 during assembly in that it restricts the end of the tap wire 28 from being deflected down into the aperture 30 thus insuring positive mechanical and electrical engagement between the contact element 35 and the tap wire 28.

As best shown in FIG. 2, side 37 of the contact element 35 is disposed, prior to the application of a stripping force, through the channel 26 such that application of the stripping force will cause the contact element to pierce the insulation of both the tap wire 28 and through wire 29 simultaneously and engage the conductor portions of the wires. Such a construction provides for maximum support for the contact element 31 prior to assembly yet does not require enlarging the size of the connector to provide such support. The simultaneous engagement of both wires provides a balanced load on the contact element and retards tipping.

The base portion 21 is provided with a slot 41 extending into the channel 27 so as to provide access for the through wire 29, without having to electrically disconnect the through wire 29. A groove 42 is disposed in the wall of the base portion 21 defining the through channel 27 and is positioned in the wall substantially diametrically opposite the slot 41. Such a structure provides for resilient relative separation of the walls defining the slot 41 since the narrowed portion 42 of the base portion 21 adjacent the groove functions as a hinge. The cover portion 22 is formed having a pair of legs 43 and 44 disposed at an acute angle to each other with the leg 44 terminating in a latch in the form of a hook portion 45 adapted to securely engage a complementary latch retainer in the form of a hook receiving portion 46 in the base portion 21. In the assembled position, the resilient tendency of the legs 43 and 44 to return to their original as molded position increases the retention between the hook portion 45 and hook receiving portion 46.

Figure 4:
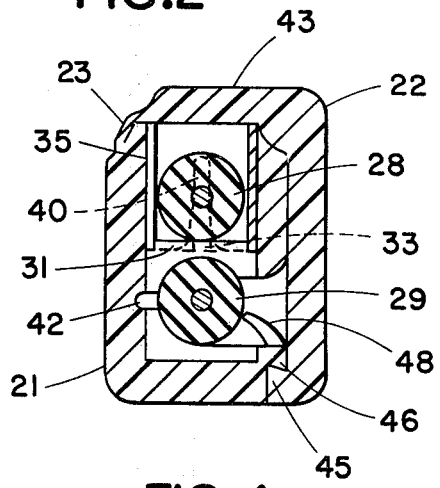
FIg. 4 is a sectional view showing an alternative embodiment and showing the contact element in engagement with the tap wire.
Figure 6:
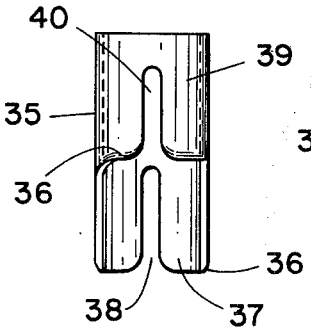
FIG. 6 is a front view of the contact element built in accord with the present invention.
Figure 7:
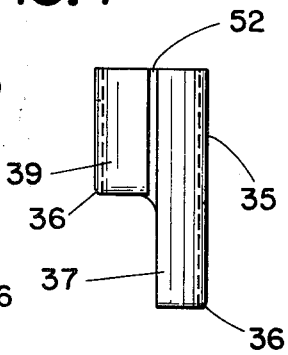
FIG. 7 is a side view of the contact element shown in FIG. 6.
Figure 8:
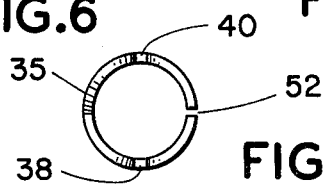
FIG. 8 is a top view of the contact element of FIG. 6.

An alternative embodiment is provided in FIG. 4 wherein a resilient tab 48 projects from the wall of the base portion defining the slot 41 toward the channel 27. It should be appreciated that upon insertion of the through wire 29 into the slot 41, the tab 48 is deflected from its position in FIG. 4 until the wire is positioned in the channel 27 at which point the tab returns to the position shown in FIG. 4 and restrains outward movement of the wire 29. As best shown in FIGS. 6 through 8, the contact element 35 is substantially cylindrical or tubular at the upper portion and has an opening 52 disposed longitudinally therein for mating engagement with a projection 53, as best shown in FIG. 5, extending into the aperture 30 so as to eliminate relative rotation between the contact element 31 and the base portion 21. The lower portion of the contact element is substantially semi-tubular.

Figure 9:
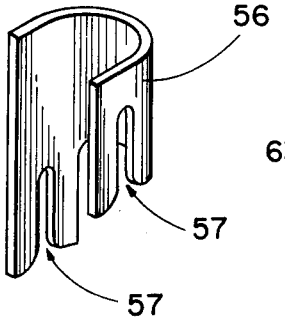
FIG. 9 is an isometric view of an alternative contact element.
Figure 10:
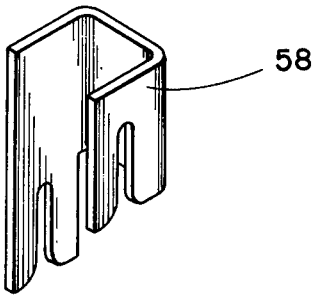
FIG. 10 is an isometric view of another alternative contact element.

In FIG. 9, an alternative embodiment of a connector element 56 is disclosed and comprises a substantially U-shaped member having slots 57 disposed in the leading edges of the respective sides of the U. In FIG. 10, alternative contact element 58 is disclosed and comprises a channel shaped member having the sides slotted in alignment with the respective channels. In addition to these modifications, a multi-sided contact element could be utilized, e.g. hexagonal. It will be appreciated that the configuration of the aperture 30 when utilizing the alternative embodiments could be altered so as to provide a substantially complemental opening. In the embodiments of FIGS. 9 and 10, the outer boundary of the contact element engages the guiding surface defined by the walls of the aperture of the connector to substantially restrict any movement that would cause the contact element to tip.

Figure 11:
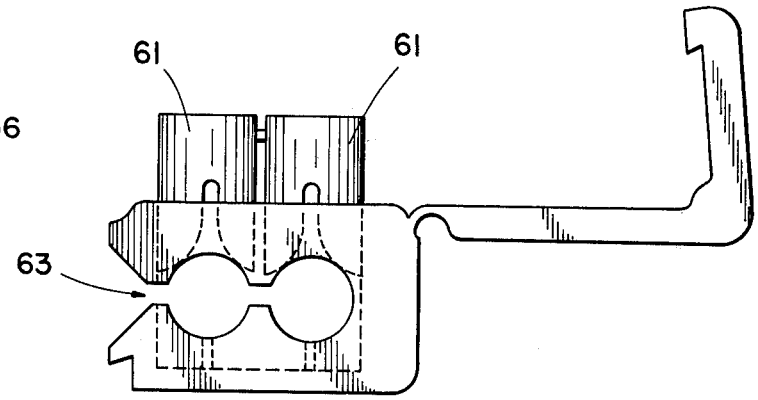
FIG. 11 is an enlarged sectional view of an alternative embodiment of a self-stripping connector.
Figure 12:
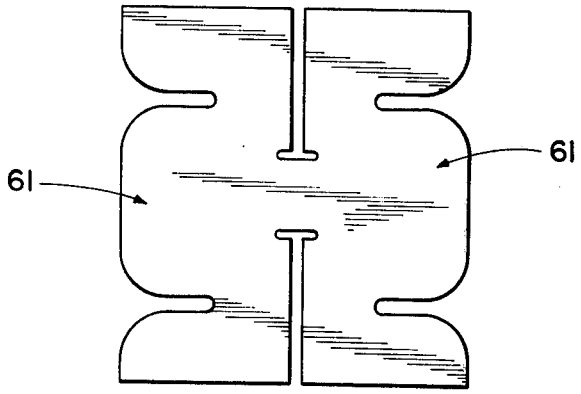
FIG. 12 is a top plan view of a blanked contact element prior to forming for use in the connector as shown in FIG. 11.

The embodiment of FIG. 11 comprises a pair of joined side by side cylindrical members forming the contact element 61 and fitting into a complementary aperture. This embodiment additionally disclosed a slot 63 providing access to both of the channels in the body portion. The contact element 61 is shown as a blanked piece of sheet metal in FIG. 12.

Figure 13:
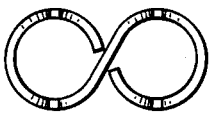
FIG. 13 is a bottom view of an alternative contact element for the connector of FIG. 11.

In FIG. 13, the contact element is substantially in the shape of a figure eight. It will be readily appreciated that such a contact element could additionally be S-shaped or in the shape of a rounded M wherein the curved portions disposed above the respective channels are substantially tangent to a plane perpendicular to the axes of the channels and slotted at the points of tangency to provide mechanical and electrical engagement with the respective wires disposed in the channels.

Figure 14:
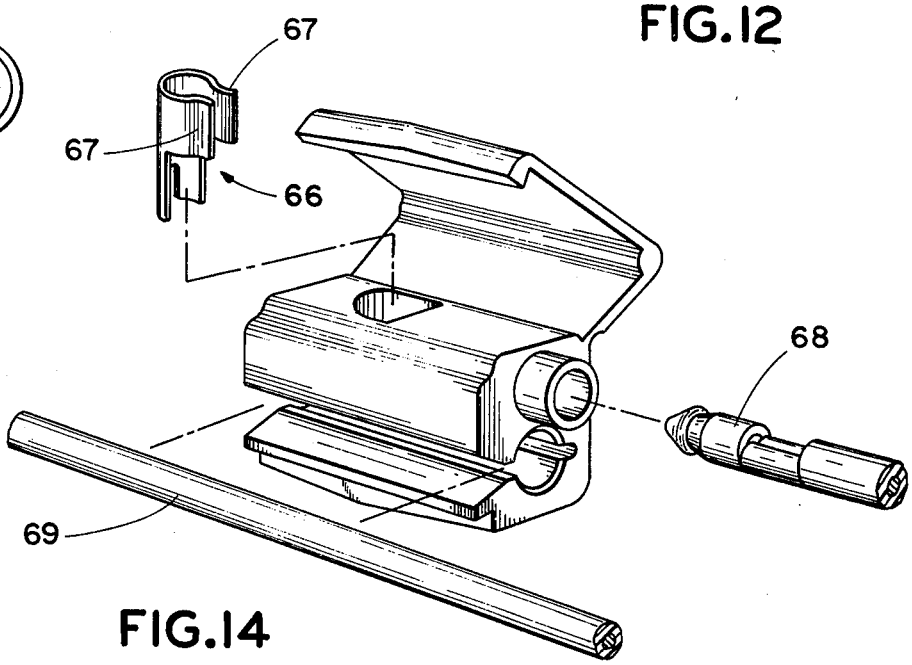
FIG. 14 is an enlarged exploded view of another alternative embodiment of a self-stripping connector.

In FIG. 14, a contact element 66 takes the form of a semi-tubular member having sides or arms 67 continuing in the direction of curvature and disposed toward one another for resiliently retaining a connector 68 adapted to be positioned in the tap channel. The aperture in the base is configured so as to be complementary to the contact element 66. It will be readily appreciated that this embodiment is assembled by first applying the stripping force to the contact element 66 to move the contact element into engagement with a through wire 69 whereupon the connector 68 is merely plugged into resilient connection with the arms 67.

Figure 15:
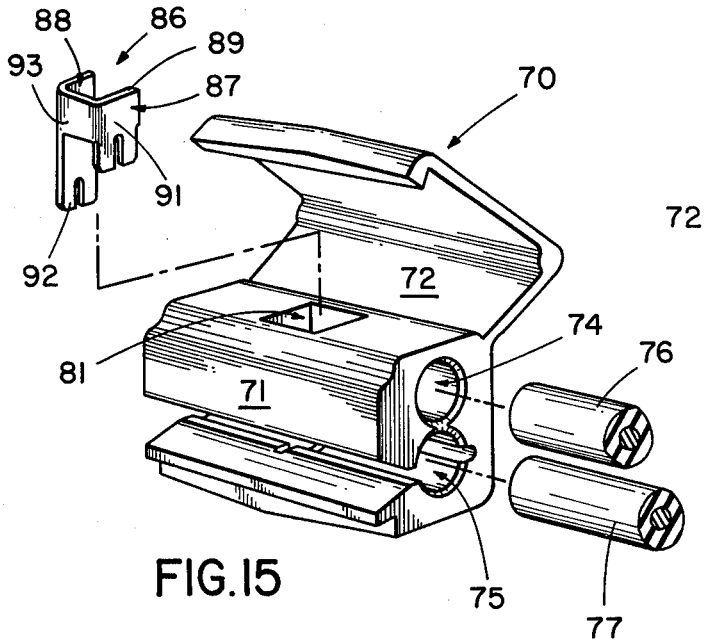
FIG. 15 is an enlarged exploded view of a self-stripping connector built in accord with an alternative embodiment of the present invention.
Figure 16:
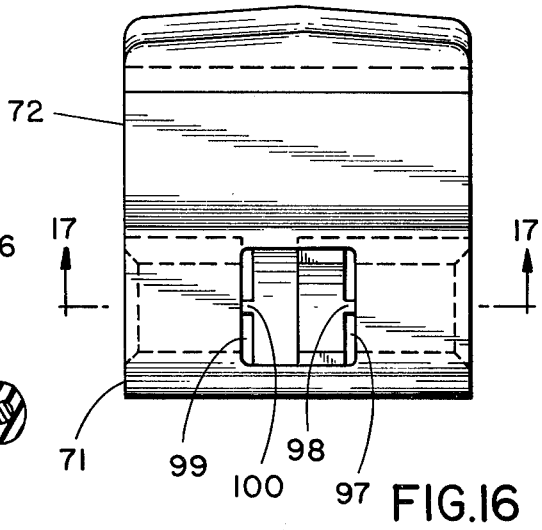
FIG. 16 is a top view of the connector of the present invention.
Figure 17:
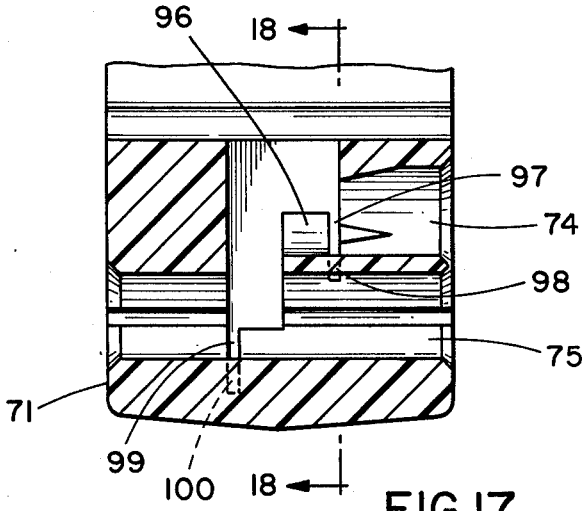
FIG. 17 is a partial sectional view taken along Lines 17—17 of FIG. 16.

An alternative embodiment as shown in FIG. 15 wherein a self-stripping connector generally indicated at 70 comprises a base portion 71 and a cover portion 72. The base portion 71 is provided with a pair of longitudinally extending channels 74 and 75 adapted for receiving a pair of insulated wires 76 and 77 and has an aperture 81 extending transversely of and intersecting each of the channels 74 and 75. The aperture 81 is substantially rectangular in cross-section at the top surface of the base portion 71.

A contact element 86 is adapted to be positioned in the aperture 81 and is preferably formed from a piece of flat sheet metal stock having a first surface 87 and a second surface 88 joined by an edge surface 89. As shown in FIG. 15, the contact element 86 is formed into a configuration that is substantially complementary to the aperture 81 and has a first portion or side 91 slotted in alignment with the axis of the channel 74 and a second portion or side 92 slotted in alignment with the axis of the second channel 75. The sides 91 and 92 are joined by a third portion or side 93 extending substantially parallel to a plane containing the axes of the channels whereby the contact element is open at its top and enables visual inspection of the wires 76 and 77 before, during, and after the contact element 86 is positioned in mechanical and electrical engagement with the wires. It will be appreciated that by positioning the contact element 86 in the position as shown in FIG. 15 the edge surface 89 adjacent the top of third side 93 will be positioned for engagement with a pair of pliers used to apply the stripping force. Prior to the application of the stripping force, both the sides 91, 92 are positioned in the aperture 81 similar to the embodiment as shown in FIG. 2 and the second side 92 extends past the channel 74. In such a position, the contact element 86 is adequately supported to retard any tipping force during assembly. A fourth side may be provided to extend from the second side 92 toward the first side 91 to provide additional engagement between the contact element and the walls of the aperture 81.

Figure 18:
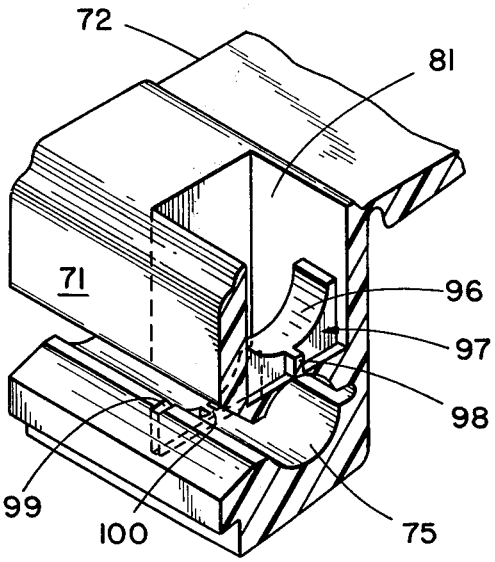
FIG. 18 is a sectional view of FIG. 17 assuming FIG. 17 to be shown in full, taken along Lines 18—18.

As best shown in FIG. 18, a ledge or saddle portion 96 extends into the aperture 81 to provide support for the wire 76 between sides 91, 92 of the contact element 86. Thus, it will be appreciated that the wire 76 will be supported on both longitudinal sides of the slotted portion of side 91 of the contact element 86 when the contact element is urged into engagement with the wire 76. A groove 97 is disposed in the ledge 96 and may be continuous or an abutment 98 may extend thereinto substantially in alignment with the axis of the channel 74 and in alignment with the slot in side 91. It will be appreciated that once the contact element 86 is positioned in the aperture 81, the side 91 thereof will be positioned in the groove 97 such that longitudinal movement relative to the channels 74, 75 is prevented. THe base portion 71 is provided with an additional groove 99 extending into the wall defining the second channel 75 for receiving the second side 92 of the contact element 86. A further abutment 100 is disposed in groove 99.

Figure 19:
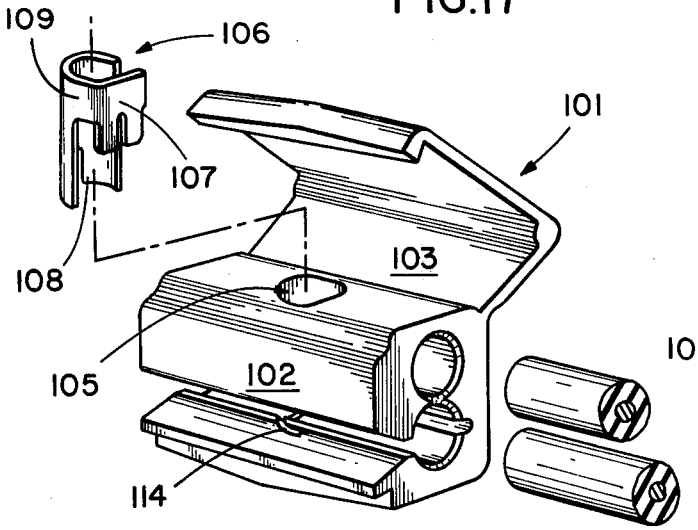
FIG. 19 is an enlarged exploded view of a self-stripping connector built in accord with an alternative embodiment of the present invention.
Figure 20:
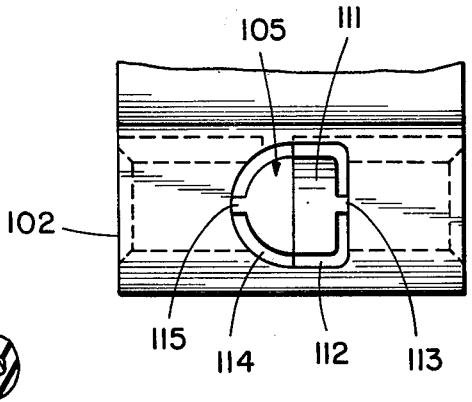
FIG. 20 is a partial top view of the connector insulating body shown in FIG. 19.

A further embodiment is disclosed in FIG. 19 wherein a self-stripping connector is generally indicated at 101 comprising a base portion 102 and a cover portion 103 and corresponding substantially to the embodiment of FIG. 15 except that an aperture 105 is generally D-shaped adjacent the top surface of base portion 102. A contact element 106 is substantially complementary thereto with a first side 107 being substantially flat and a second side 108 being substantially arcuate. Sides 107 and 108 being joined by a third side 109 substantially parallel to a plane connecting the axes of the channels. The contact element of FIG. 19 could additionally be used in the base portion 71 as shown in FIG. 15. In such a construction, the second side 108 would be tangent to the adjacent retilinear wall of the aperture 81. As shown in FIG. 20, a ledge 111 extends into the aperture 105 and is provided with a groove 112 having an abutment 113 for receiving the first side 107. The wall of the base portion 102 defining the bottom channel is similarly provided with a groove 114 and abutment 115.

While there has been illustrated and described what is at present considered to be the preferred embodiment of the invention in addition to several alternative embodiments and modifications, it will be appreciated that numerous changes and modifications are likely to occur to those skilled in the art and it is intended in the appended claims to cover all those changes and modifications which fall within the true spirit and scope of the present invention.

What is claimed is:

1. A self-stripping wire connector adapted for making positive electrical connection to a pair of wires comprising an insulating body having a base portion and a cover portion, one of said portions being provided with a pair of elongate wire receiving channels, each of said channels being adapted to receive an insulated wire, said one of said portions having a wall or walls defining an elongate aperture therein with its longitudinal axis intersecting each of said channels, said channels being stacked in the direction of elongation of said aperture, the wall or walls of said one of said portions define a guiding surface, and a contact element positioned in said aperture and adapted to engage each of said pair of wires for making electrical and mechanical engagement therewith, said contact element comprising first and second surfaces having an edge surface therebetween, said first surface defining an outer boundary disposed adjacent said guiding surface at points spaced on said boundary lying in nonparallel planes.

2. The connector of claim 1 wherein said contact element comprises a pair of curved portions and the section of each curved portion tangent to a plane perpendicular to a plane connecting the axes of the channels is slotted in alignment with its respective channel.

3. The connector of claim 1 wherein a projection extends from the wall defining said aperture into said aperture and wherein said contact element has a slot therein positioned for guiding engagement with said projection to eliminate rotational movement of said contact element relative to said one of said portions.

4. The connector of claim 1 wherein one of said channels extends to said aperture and wherein a portion of said contact element is adapted to extend past an axis of said one of said channels into engagement with a wire positioned in the other of said channels, said element being adapted to substantially concurrently engage wires disposed in the respective channels as it is moved in said aperture toward said channels.

5. The connector of claim 1 wherein a plane joining the axis of each channel is parallel to the direction of extension of said aperture and wherein a ledge extends into said aperture from the wall defining the channel closer the element receiving end of the aperture, said ledge being adapted to provide support for an insulated wire disposed therein whereby said insulated wire is supported on both longitudinal sides of the portion of said contact element making engagement with the wire.

6. The connector of claim 1 wherein said contact element is substantially hexagonal in cross section and wherein the cross section of said aperture is substantially hexagonal, the flat sides of said contact element engage the walls of said aperture to prevent rotational movement of said contact element relative to said aperture.

7. The connector of claim 1 wherein said contact element when disposed in said aperture defines an opening whereby visual inspection will determine whether the wires are properly positioned in said channels both before and after assembly.

8. The connector of claim 1 wherein said contact element is curved having a slot in line with one of said channels; the sides of said contact element being disposed toward one another for resiliently retaining a connector positioned in the other of said channels.

9. The connector of claim 1 wherein part of said aperture is substantially cylindrical and wherein said contact element has a partially circular cross section, the outer boundary of said contact element being disposed adjacent the wall defining said aperture throughout the periphery thereof.

10. The connector of claim 9 wherein a resilient tab projects from one of the walls of said base portion defining said slot toward said one of said channels for resiliently retaining a wire inserted past said resilient tab into said one of said channels from movement in a direction out of said one of said channels, said tab being spaced from said wire when the wire is in its connected position.

11. The connector of claim 9 wherein a groove is disposed in the wall defining said one of said channels and positioned substantially diametrically opposite said slot to enable resilient relative separation of the opposing walls defining said slot, said groove extending generally normally to a plane connecting the axis of each channel.

12. The connector of claim 1 wherein at least a wall of said one of said portions defining said aperture is rectilinear and wherein said contact element has a curved portion thereof disposed adjacent the rectilinear wall.

13. The connector of claim 12 wherein at least a wall of said insulating body defining said aperture is rectilinear and wherein said contact element has a curved portion thereof disposed adjacent the rectilinear wall.

14. A self-stripping wire connector adapted for making positive electrical connection to a pair of wires comprising an insulating body having first and second elongate channels extending into said insulating body, each of said channels being adapted to receive an insulated wire, said insulating body having an elongate aperture therein extending transversely of and intersecting each of said channels, said channels being stacked in the direction of elongation of said aperture, the wall or walls of said insulating body defining said aperture define a guiding surface, and a contact element positioned in said aperture for electrical and mechanical engagement with each of a pair of wires, a tap wire is adapted to be positioned in said first channel, and a through wire or tap wire is adapted to be positioned in said second channel, said contact element is provided with a curved first portion slotted in alignment with the longitudinal axis of said first channel for making conductive contact with a wire supported in said first channel and a curved second portion longitudinally spaced relative to said channels from the first portion and slotted in alignment with the longitudinal axis of said second channel for making conductive contact with a wire supported in said second channel, said second portion extending into said aperture and intersecting said longitudinal axis of said first channel prior to the insertion of a tap wire in said first channel.

15. The connector of claim 14 wherein a wire is restricted from longitudinal movement in said first channel past said second portion of said contact element.

16. The connector of claim 14 wherein a ledge extends into said aperture adjacent the wall defining said first channel and is adapted to provide support for an insulated wire disposed therein whereby said insulated wire is suppported on both longitudinal sides of said contact element when said insulated wire is positioned in said first channel.

17. The connector of claim 16 wherein said first and second portions are joined by a third portion extending parallel to a wall of said aperture whereby said contact element is open at the top thereof thereby permitting visual inspection of said wires before and after electrical and mechanical engagement is made between said contact element and said wires.

18. The connector of claim 14 wherein a stop projects from said insulating body into the aperture and restrains movement of said contact element in the direction of said channels.

19. The connector of claim 18 wherein said stop is complementary in shape to the contact element.

20. A self-stripping wire connector for making an electrically conductive mechanical connection between a pair of insulated wires, said connector comprising:

an insulative body having a pair of elongate channels each of which is adapted to received one of said wires; and an elongate generally tubular electrically conductive contact element for connecting said wires, said body including a generally cylindrical inner surface sized complimentary to said element and defining an elongate aperture for receiving said element, said aperture intersecting each of said channels and said channels being stacked in the direction of elongation of said aperture, said element comprising a first portion slotted in alignment with the longitudinal axis of one of said channels for receiving and stripping the insulation from the wire disposed in that channel, said element similarly comprising a second portion slotted in alignment with the longitudinal axis of the other of said channels for receiving and stripping the insulation from the wire disposed therein, said portions being longitudinally and laterally offset relative to one another and adapted to substantially concurrently engage the respective wires disposed in said channels upon said element being forced into said body.

* * * * *